US005260155A

United States Patent [19]

Mey et al.

[11] Patent Number: 5,260,155

[45] Date of Patent: Nov. 9, 1993

[54] XEROPRINTING METHOD, MASTER AND METHOD OF MAKING

[75] Inventors: William Mey, Rochester; George G. Fulmer, Victor; Dennis R. Kamp, Spencerport, all of N.Y.

[73] Assignee: Eastman Kodak Company, Rochester, N.Y.

[21] Appl. No.: 553,034

[22] Filed: Jul. 16, 1990

[51] Int. Cl.[5] ..... G03G 13/00

[52] U.S. Cl. ..... 430/49; 430/54; 430/126

[58] Field of Search ..... 430/49, 54, 902, 126

[56] References Cited

U.S. PATENT DOCUMENTS

| | | | |
|---|---|---|---|
| 3,271,146 | 9/1966 | Robinson | 96/1.4 |
| 3,954,463 | 5/1976 | Bhaget | 96/1.4 |
| 4,002,475 | 1/1977 | Ott et al. | 96/1 E |
| 4,254,199 | 3/1981 | Tutihasi | 430/58 |
| 4,255,505 | 3/1981 | Hanada et al. | 430/31 |
| 4,330,610 | 5/1982 | Hewitt | 430/126 |
| 4,339,518 | 7/1982 | Okamura et al. | 430/126 |
| 4,804,602 | 2/1989 | Buettner et al. | 430/42 |
| 4,880,715 | 11/1989 | Tam et al. | 430/41 |
| 5,101,216 | 3/1992 | Mey et al. | 346/1.1 |

OTHER PUBLICATIONS

Schaffert, Electrophotography, p. 209, 2nd Edition (1975).

*Primary Examiner*—Marion E. McCamish
*Assistant Examiner*—Rosemary Ashton
*Attorney, Agent, or Firm*—Leonard W. Treash, Jr.

[57] ABSTRACT

A xeroprinting master includes a fixed insulative toner image on an electrophotographic element of the type exhibiting charge injection at an interface between a charge injection electrode and a charge transport layer. In xeroprinting use the master is charged to a polarity opposite that which is injectable. The charge is neutralized by charges injected from the electrode which migrate to the charged surface. Charge retained on the fixed toner image can be toned. The master can be made by positively charging it to a polarity the same as that which is injectable, imagewise exposing it and toning and fixing.

5 Claims, 2 Drawing Sheets

XEROPRINTING METHOD, MASTER AND METHOD OF MAKING

FIELD OF THE INVENTION

This invention relates to xeroprinting and more particularly to a method of forming images using xeroprinting, to a xeroprinting master for use in said method and a method of making said master.

BACKGROUND ART

A very early approach to making xeroprinting masters is shown in Schaffert, ELECTROPHOTOGRAPHY, page 209, 2nd Edition (1975). According to that approach an insulating toner is fused in imagewise configuration onto a conductive substrate and the substrate is repeatedly charged and toned to create toner images which are transferred to receiving sheets. Unfortunately, this type of master can produce poor image reproduction due to lack of uniformity of charge on the insulating toner. This nonuniformity is believed to be due to the conductive portions of the master affecting the electrical field associated with the insulating portions during the charging process.

Photoconductive elements have been used as masters. The toner image can be formed electrophotographically on photoconductive elements rather than transferred to them as in the Schaffert master. In use, the entire master with the toner image is uniformly charged. It is then blanket exposed to radiation to which the photoconductive surface is sensitive thereby discharging the portions not covered by the image. The remaining electrostatic image is toned and transferred as in previous processes. This process does not create the lack of uniformity found with the original Schaffert xeroprinting masters if the original charging is in the dark, but it requires a blanket exposure step.

U.S. Pat. No. 3,271,146 shows a xeroprinting process using a zinc oxide photoconductive element. Zinc oxide will hold a negative charge in the dark, but is conductive to positive charges. The photoconductiveness to negative charge is used to electrophotographically form the master and its conductivity to positive charge is used in the xeroprinting process.

U.S. Pat. No. 4,804,602, Buettner et al, issued Feb. 14, 1989, and other references note the phenomenon of positive charge injection. Some photoconductor-electrode combinations exhibit the characteristic of positive charge injection at the interface between the electrode and the photoconductor. With these materials, when negative charges are sprayed on the surface opposite the electrode, the positive charges or holes migrate to the surface and neutralize them. The same materials hold positive charges in the dark and may or may not be photoconductive, that is, transport the charges to the electrode when exposed to light.

STATEMENT OF THE INVENTION

It is the object of the invention to provide a xeroprinting process which does not exhibit the characteristic of lack of uniformity of charge on the insulating portions of the master and does not require an exposure step in xeroprinting.

This and other objects are accomplished by using as a xeroprinting master, an element having a charge transport layer—charge injecting electrode interface that exhibits the phenomenon of positive charge injection. Thus, the invention provides a novel xeroprinting master comprising such an element which has an image of insulating material on a surface of the charge transport layer opposite the charge injecting interface.

The invention also provides a method of using such a master in which the master is charged negatively to create a negative electrostatic image on the areas of insulating material. Toner is applied to the master to create a toner image defined by the electrostatic image, which image can be transferred to a receiving sheet and fixed or otherwise utilized. This process is repeated for as many images as are desired.

A surprising result of the invention is that a positive charge injection master appears to a negative corona charging electrode as an equipotential surface for a short time during charging. In a rapid xeroprinting process, the decay of the non-image portions is slow enough not to disturb the charging of the insulating portions but fast enough to be toned in a highspeed duplicator.

A master according to the invention can be made by transferring toner in image configuration to an appropriate element and fixing it. However, according to a further preferred embodiment, if the charge transport layer is photoconductive as to one polarity, the master can be made by charging the element to that polarity, for example, positively, imagewise exposing it to create an electrostatic image and applying an insulating toner to create a toner image defined by the electrostatic image. This toner is fixed, for example, by fusing, to create a xeroprinting master.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1A:
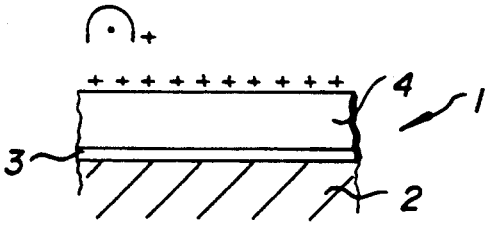
FIGS. 1(*a*), 1(*b*), 1(*c*), 1(*c*)', 1(*d*), 1(*d*)', 1(*f*) and 1(*g*) illustrates with steps (a)–(g) a preferred method of making a master according to the invention.
Figure 1B:
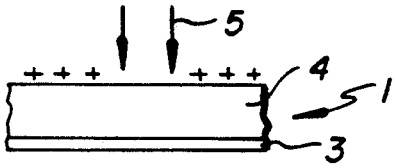
Figure 1C:
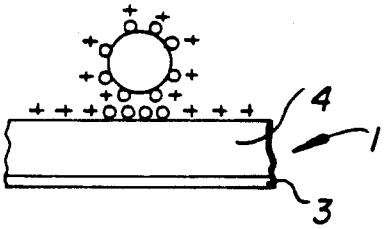
Figure 1C:
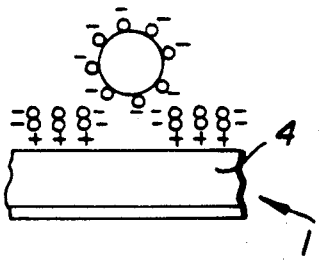
Figure 1D:
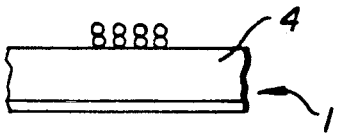
Figure 1D:
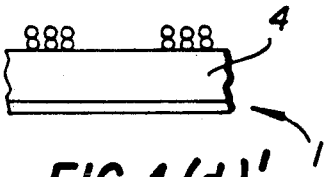
Figure 1F:
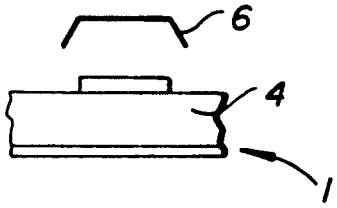
Figure 1G:
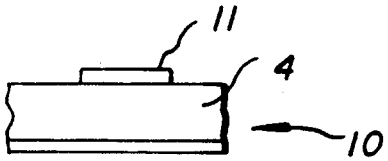

According to FIG. 1 a xeroprinting master is made by following steps illustrated as steps (a)–(g). An image forming element 1 comprises materials which exhibit positive charge injection. In the preferred form of the element, the element is photoconductive as to positive charges, that is, positive charges stay on the surface in the dark but transport through the surface in response to appropriate radiation.

For example, element 1 can include a substrate 2, a charge injection layer 3 and a charge transport layer 4 which charge injection layer 3 and charge transport layer 4 have an interface which exhibits positive charge injection from the electrode into the transport layer. Thus, if negative charges are sprayed on the surface of charge transport layer 4 opposite the interface, positive charges or "holes" injected from the electrode into the charge transport layer migrate to the surface and neutralize the negative charges thereby reducing the potential of the surface. For use in the preferred FIG. 1 embodiment, the charge transport layer 4 must be photoconductive as to positive charges. That is, positive charges sprayed on the surface in the dark will stay on the surface but will transport through the surface to the electrode 3 in response to radiation of an appropriate wavelength. For other embodiments, photoconductivity is not necessary.

According to FIG. 1(*a*), at step (a) the image-forming element 1 is sprayed with positive charge in the dark, which positive charge collects on the outside surface of charge transport layer 4 (the surface opposite the interface with charge injection electrode 3). At FIG. 1(*b*) element 1 is exposed to imagewise radiation, for example, radiation 5 from a laser, which makes charge transport layer 4 relatively conductive. The positive charge migrates to electrode 3 forming an electrostatic image of positive charge on the surface of charge transport layer 4.

At FIGS. 1(*c*) and 1(*c*)' toner is applied to the surface to create a toner image defined by the electrostatic image. In 1(*c*) positively charged toner is applied to the surface, toning the discharged portions of the image and creating a toner image corresponding to the portions exposed with radiation in step (b). In 1(*c*)', negatively charged toner is applied to the surface, creating a toner image where positive charge existed corresponding to the portions not exposed by radiation from laser 5. As shown at FIGS. 1(*d*) and 1(*d*)', element 1 has a loose toner image representing either the exposed or unexposed portions of charge transport layer 4.

As shown at 1(*f*), the toner image is fixed, for example, by passing it under a fuser 6 thereby creating a fused toner image on a surface of charge transport layer 4 shown in 1(*g*) which now becomes a xeroprinting master 10.

The same result could be achieved by imagewise positive ion projection, toning and fixing. Similarly, a toner image could be formed by ordinary electrophotographic means on a separate electrophotosensitive member and transferred to element 1 and then fixed. In these latter embodiments, the charge transport layer need not be photoconductive as to positive charge. However, this requires additional apparatus and the additional step of transfer invariably causes some losses in resolution.

Figure 2A:
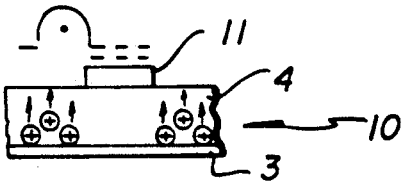
FIGS. 2(*a*), 2(*b*), 2(*c*)', 2(*d*), 2(*e*), 2(*f*), and 2(*g*) illustrates in steps (a)–(g) a preferred method of using a master made according to the invention.
Figure 2B:
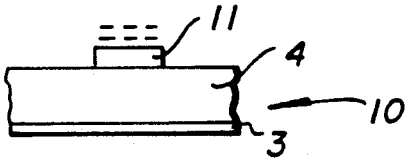
Figure 2C:
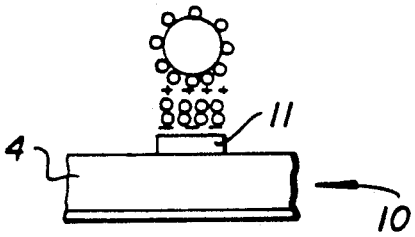
Figure 2C:
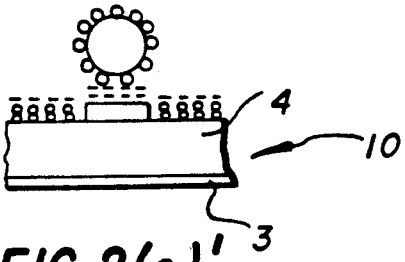
Figure 2D:
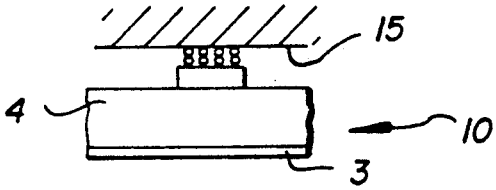
Figure 2E:
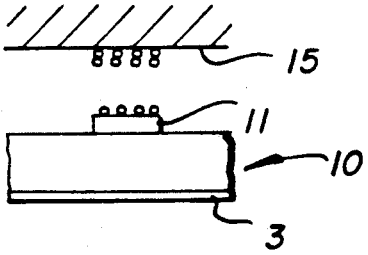
Figure 2F:
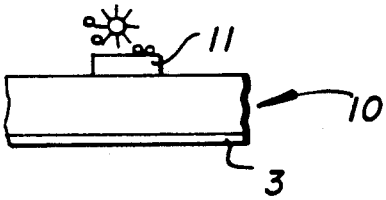
Figure 2G:
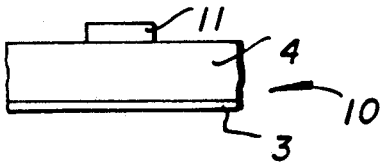

According to FIG. 2 the master 10 is used in xeroprinting by repeatedly subjecting it to steps (a)–(g) to provide a plurality of toner images from the same master.

As shown in FIG. 2(*a*), the master 10 is sprayed with negative electrostatic charges with or without the presence of radiation. The charge transport layer 4 is injected with positive charges from electrode 3, and charges of a negative polarity are quickly neutralized. Negative charges adhere for any length of time only to the areas 11 of fixed toner. More specifically, the charge injection electrode 3 injects positive charges or holes into the charge transport layer 4 which charges migrate to the surface opposite the interface between electrode 3 and layer 4 to neutralize the negative charges in the areas not covered by the toner 11. This reduces the potential in these areas to form a negative electrostatic image conforming to the toner image as shown in 2(*b*). The negative electrostatic image is toned by the application of either positive or negative toner as shown in 2(*c*) and 2(*c*)' respectively. The positive toner adheres to the negative charge in the areas covered by the toner image 11 while the negative toner adheres to the discharged areas not covered by the toner image 11. At FIG. 2(*d*) the toner image is brought into intimate contact with a receiving surface 15, preferably in the presence of an electric field, not shown, to transfer the loose toner image to the receiving surface 15 as shown at FIG. 2(*e*). As shown at FIG. 2(*f*), the master is cleaned, preferably by a magnetic brush cleaner, to make it ready as shown in 2(*g*) to repeat the process and form another toner image.

A remarkable and useful aspect of this process is that the decay of the negative charge in the xeroprinting process is slow enough that charge deposition on the fused toner is not affected. That is, the charging process sees an equipotential surface. However, decay is fast enough to tone the image in a high production xeroprinting process.

Many combinations of materials exhibit the characteristic of positive charge injection. It appears to be dependent upon the combination of materials of both the charge transport layer and the charge injection electrode.

The xeroprinting master described in this invention uses an electrically conductive layer which is capable of injecting electron holes into a contiguous charge-transport layer which may be photoconductive. Suitable conductive, charge injecting, layers include gold, carbon, CuI and other materials with low reduction potentials. It is presently preferred to use cuprous iodide as the conductive hole injecting material. Cuprous iodide can be dissolved in a polymeric binder at anywhere between 60% to 98% by weight. Any of a number of known binder polymers, for example, those described in U.S. Pat. No. 4,804,602, can be used. U.S. Pat. No. 4,804,602 is incorporated by reference herein.

EXAMPLE 1

A charge transport layer was machine coated onto a CuI containing conductive layer which had been solvent coated on a polyester support. The film contained the following components: 1487.5 grams of dichloromethane, 637.5 grams of 1,1,2-trichloroethane, 1.76 grams of 1,3,3-trimethyl-2-[7-(1,3,3-trimethyl-5-nitroindolidene-2-yl)-4-chloro-3,5-trimethylene-1,3,5-heptatrienylidene]-5-nitroindolium hexafluorophosphate, 271.4 grams of poly(vinyl-m-bromobenzoate)-co-(vinyl acetate), 17.3 grams of poly(2,2'-dimethyl-1,3-propylene-co-ethylene terephthalate, 86.2 grams of 1,4-bis(-bis[4-(N-benzyl-N-ethylamino)-2-methylphenyl]-methyl) benzene, and 7.5 grams, of a 10% solution, of Dow Corning's DC-510. The dry thickness of this charge transport layer was about 9 microns.

A xeroprinting master was made by first corona charging the film positively with a grid controlled charger set at a grid potential of +500 volts, then imagewise exposing the film to radiation from an incandescent light source, and finally developing the latent image (neg/pos development with the development bias set at +400 volts) with black, insulating, positively charged toner. The image was then fixed by heating in an oven at 120 degrees C. for about 10 seconds. The image consisted of halftone dots ranging in screen frequency from 85 to 150 lines per inch with percent dots varying from 5% to 90%.

The xeroprinting master was mounted on an electrographic machine equipped with a grid-controlled corona charger, a development station, a toner transfer station and a magnetic brush cleaning station. The master was corona charged negatively, developed with a black toner about 7 microns in diameter. The toner was transferred to bond paper using an electrostatic roller transfer mechanism. The master was then cleaned with a magnetic brush-cleaner and the above process repeated. The images were fused off-line in a separate heated roller fuser apparatus. The machine was operated at about 10 inches per second process speed. Five thousand high quality prints were made using this process illustrating that this master can be used for high quality short-run printing.

EXAMPLE 2

A charge transport layer was machine coated onto a CuI containing conductive layer which had been solvent coated on a polyester support. The film contained the following components: 1204 grams of dichloromethane, 516 grams of 1,1,2 trichloroethane, 1.68 grams of 1,3,3-trimethyl-2-[7-(1,3,3-trimethyl-5-nitroindolidene-2-yl)-4-chloro-3,5-trimethylene-1,3,5-heptatrienylidene]-5-nitroindolium hexafluorophosphate, 159.3 grams of poly[4,4'-(hexahydro-4-7, methanoidene-5-ylidene)bis(phenol) diethylene-co-pthylene terephthalate], 22.75 grams of Makrolon #5705, 98 grams of 1,1,5,5-tetrakis(4-N,N-diethylamino-2-methylphenyl)-pentaryl,4-bis(bis[4-(N-benzyl-N-ethylamino)-2-methylphenyl]methyl) benzene, 6 grams, of a 10% solution, of Dow Corning's DC-510 and 1 gram of poly(bisphenol A)adipate-b-poly(dimethylsiloxaine). The dry thickness of this layer was about 9 microns.

A xeroprinting master was made using this film in a similar manner to that described in Example 1. This xeroprinting master was mounted on the electrographic machine and a number of high-quality prints were produced. It was found that, if the master was heated on a hot plate at 120 degrees C. for an additional 30 seconds, improved performance was obtained. That is, the contrast potential, the voltage difference between the toned and untoned areas of the master, was increased leading to higher densities on the prints.

In a separate experiment, the same master as described above was mounted on the electrographic machine. This time the magnetic brush cleaning station was replaced with a fur brush cleaning station. The process for making prints was repeated as described in Example 1 and again good quality prints were obtained. However, it appears that, while fur brush cleaning adequately cleaned the non-planar master, magnetic brush is the preferred method of cleaning.

Thus, several advantages are obtained according to the invention. A xeroprinting master is provided which exhibits excellent uniformity of charge in the xeroprinting process without the attraction of charge away from the insulative portions. It is easily made and does not require a blanket exposure step when used in xeroprinting.

The invention has been described in detail with particular reference to a preferred embodiment thereof, but it will be understood that variations and modifications can be effected within the spirit and scope of the invention as described hereinabove and as defined in the appended claims.

We claim:

1. A xeroprinting master comprising, a charge transport layer coated or otherwise intimately fixed on a charge injecting electrode which layer and electrode are of materials which define an interface exhibiting positive charge injection from the charge injecting electrode into the charge transport layer, and an image of insulating material fixed on the surface of said charge transport layer opposite from said interface, said insulating material image being capable of holding a charge under conditions in which positive charge injection from said charge injection electrode substantially neutralizes negative charge on said non-image portions of said surface to render said non-image portions incapable of holding a negative charge even without the presence of activating radiation.

2. A method of using the xeroprinting master of claim 1 to form a plurality of toner images, said method comprising:

charging said opposite surface to create an electrostatic image defined by electrostatic charge on said insulating material, applying toner to said surface to create a toner image defined by said electrostatic image, transferring said toner image to a receiving surface, and repeating the above steps to form a plurality of toner images with said master.

3. A method of forming a xeroprinting master, said method comprising, providing an image-forming element having a photoconductive charge transport layer coated or otherwise intimately fixed to a charge injecting electrode, sid layer and electrode having an interface exhibiting positive charge injection from said electrode into said charge transport layer and the surface of said charge transport layer opposite said electrode being capable of holding only a positive charge in the absence of activating radiation, uniformly charging said opposite surface with a positive electrostatic charge, imagewise exposing said surface to create an electrostatic positive image, applying toner to said surface to create a toner image defined by said positive electrostatic image, and fixing said toner image to said surface to create a xeroprinting master.

4. A method of forming a plurality of toner images, said method comprising:

providing an image-forming element having a photoconductive charge transport layer coated or otherwise intimately fixed to a charge injecting electrode, said layer and electrode being of materials which define an interface exhibiting positive charge injection from said electrode into said charge transport layer and the surface of said charge transport layer opposite said electrode not being capable of holding a negative charge in the absence of activating radiation, uniformly charging said opposite surface with a positive electrostatic charge, imagewise exposing said surface to create a positive electrostatic image, applying toner to said surface to create a toner image defined by said positive electrostatic image, fixing said toner image to said surface to create a xeroprinting master, performing the following steps and repeating said steps to form a plurality of images with said master, charging said surface with a negative charge to create a negative electrostatic image defined by charge on said fixed toner image, applying toner to said surface to create a toner image defined by said negative electrostatic image, and transferring said toner image to a receiving surface.

5. A method of xeroprinting comprising:

applying a negative charge to a xeroprinting master for a predetermined period of time, applying toner to said master a predetermined time after said charge applying step, said master having imagewise insulating material on a surface of a charge transport layer and a charge injecting electrode opposite said surface which defines an interface with said charge transport layer through which sufficient positive charges are injected, whether or not in the presence of activating radiation, to substantially neutralize the negative charge applied to non-image portions of said master before said toner applying step but insufficient to substantially affect charge deposition on the insulating material image.

* * * * *